United States Patent [19]

Young et al.

[11] Patent Number: 4,458,450

[45] Date of Patent: Jul. 10, 1984

[54] WEATHER STRIPPING

[75] Inventors: Roy A. Young, Halton Hills; Daniel M. Cybulski, Burlington, both of Canada

[73] Assignee: Schlegel Corporation, Rochester, N.Y.

[21] Appl. No.: 322,155

[22] Filed: Nov. 17, 1981

[51] Int. Cl.[3] ..... E06B 7/16
[52] U.S. Cl. ..... 49/489
[58] Field of Search ..... 49/489, 493, 488

[56] References Cited

U.S. PATENT DOCUMENTS

| | | | |
|---|---|---|---|
| 3,404,487 | 10/1968 | Johnson | 49/489 X |
| 3,624,964 | 12/1971 | Bordner et al. | 49/489 |
| 3,690,038 | 9/1972 | Dieterich | 49/489 |

*Primary Examiner*—Kenneth Downey
*Attorney, Agent, or Firm*—Sim & McBurney

[57] ABSTRACT

The backing of a pile weather strip is scored from the underside thereof at a location between the pile strip and one side edge of the backing to permit the part of the backing between the score line and the aforesaid side to hinge so that the weather strip can be inserted into a T-slot through the opening thereof instead of being slid longitudinally into the T-slot through an open end thereof.

16 Claims, 3 Drawing Figures

WEATHER STRIPPING

BACKGROUND OF THE INVENTION

This invention relates to weather stripping that is particularly suited for sealing the spaces or joints that exist between doors, windows and other closures or the like and the frames or structural supports therefor.

Pile weather strip is well known and has been commercially available for many years. It consists of a backing to which is secured a pile strip of resilient fibers. Typical of a pile weather strip is that shown in U.S. Pat. No. 3,175,256, issued Mar. 30, 1965, R. C. Horton. The pile weather strip shown in that patent is sold under the trade mark Fin-Seal and is characterized by a barrier strip of impervious, flexible, sheet material fixed to the backing and located within the pile strip. In its more elementary form conventional pile weather strip omits the aforementioned barrier strip.

Pile weather strip commonly is supported in what is known as a T-slot. The T-slot may be in the closure element, e.g., door or window, or in the frame or support therefor. In any event, as the name implies, it is a T-shaped slot having a longitudinally extending groove (the crossbar of the T) and a longitudinally extending opening (the upright of the T) communicating with the groove and of lesser width than the width of the groove. Commonly the pile weather strip is inserted into the T-slot from an open end threof and is slid longitudinally into location in the T-slot. Generally this is not a problem when the weather strip is being installed in the closure or frame at the factory, although this mode of installation does become more difficult as the length of the T-slot increases.

Pile weather strip does wear out, of course, and it may be necessary to replace it from time-to-time in the field. In the field it may not be possible to gain access to an open end of the T-slot, at least without substantial disassembly of the closure, frame or other support, which is time-consuming and costly. Therefore, what is required is some technique that will permit pile weather stripping to be readily retrofitted in the field when access to the open end of the T-slot is not possible or difficult.

A solution to this problem is disclosed in U.S. Pat. No. 3,690,038, issued Sept. 12, 1972, Melven L. Dieterich. However, the Dieterich weather strip utilizes an extruded profile and a considerable amount of plastic material and, thus, would be comparatively expensive to make. Additionally, in the Dieterich weather strip a part of the plastic profile projects beyond the T-slot requiring a relatively large mounting distance between the closure element and the frame or support therefor, whereas the industry trend is towards smaller mounting distances. In other words, in the Dieterich weather strip the distance "g" necessarily is large in order to accommodate a notch of appropriate depth "e".

SUMMARY OF THE INVENTION

Various aspects of the invention are as follows:

A pile weather strip comprising a backing having a front surface, a bottom surface opposite to said front surface and first and second side edges; a pile strip of resilient fibers upstanding from said front surface, secured to said backing and extending longitudinally of said backing at a location spaced inwardly from said first and second side edges, whereby said backing on either side of said pile strip and between said first and second side edges constitutes flanges devoid of pile material; said weather strip being adapted to be inserted into a T-slot comprising a longitudinally extending groove having a longitudinally extending opening of lesser width than the width of said groove communicating with said groove, when said weather strip is so inserted into said T-slot said backing being located in said groove and said pile strip protruding through said opening, the width of said backing between said side edges thereof being greater than the width of said opening, whereby said weather strip is retained in said groove, said weather strip being adapted to be inserted into said T-slot either by being slid longitudinally therein through one open end of said T-slot or by passage of said backing into said groove through said opening; the latter mode of insertion of said weather strip into said T-slot being accomplished by the provision in said backing of a line of weakness extending longitudinally of said backing and inwardly from said bottom surface toward said front surface but only part way through said backing, the portion of said backing between said line of weakness and one of said edges thus being bendable in one direction about said line of weakness when said backing is inserted into said groove through said opening and then springing into said groove after passage of said portion of said backing through said opening, said line of weakness having abutable edges and resisting bending of said portion in a direction opposite to said one direction by abutment of said edges when any attempt is made to remove said weather strip through said opening, so that said weather strip cannot be readily removed from said T-slot by being pulled through said opening.

A method for inserting a pile weather strip of the type set out in the preceding paragraph into a T-slot of the type set out in the preceding paragraph which comprises inserting the portion of said backing between said line of weakness the other of said edges through said opening into said groove, pushing said weather strip towards said T-slot while bending said portion of said backing between said line of weakness and said one edge upwardly to a sufficient extent to permit the remainder of said backing to pass through said opening into said groove, and permitting said portion of said backing between said line of weakness and said one edge to spring into said groove after said portion of said backing between said line of weakness one flange has passed through said opening.

The combination of the aforesaid pile weather strip and T-slot, the weather strip being located in said T-slot with said backing in said groove and said pile extending through said opening.

BRIEF DESCRIPTION OF THE DRAWINGS

This invention will become more apparent from the following detailed description, taken in conjunction with the appended drawings, in which.

DETAILED DESCRIPTION OF THE INVENTION INCLUDING THE PREFERRED EMBODIMENTS

Figure 1:
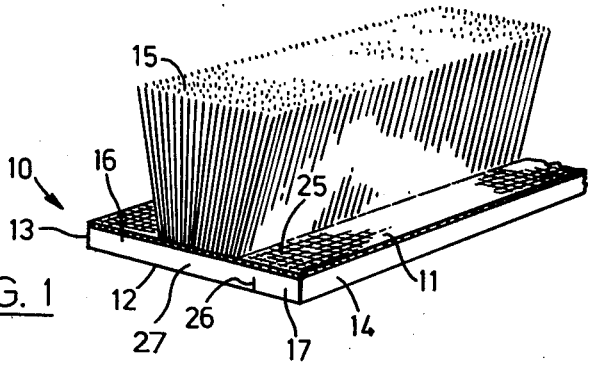
FIG. 1 is a perspective view of a piece of weather strip embodying the instant invention.
Figure 2:
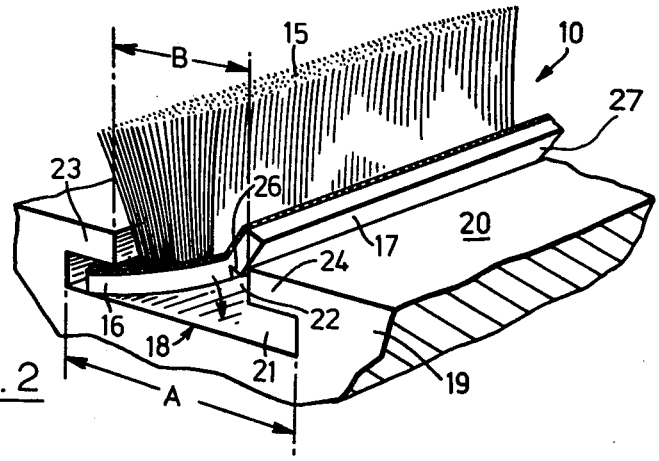
FIG. 2 shows the weather strip of FIG. 1 being inserted into a T-slot.

Referring to the drawings, one embodiment of a pile weather strip of the instant invention is shown. It includes a backing 10 having a front surface 11, a bottom surface 12 opposite to the front surface and side edges 13 and 14. Also included is a pile strip 15 of resilient fibers upstanding from front surface 11. The pile strip is secured to backing 10 in known manner, e.g., by being woven into the backing and/or adhered thereto, and extends longitudinally of the backing at a location spaced inwardly from side edges 13 and 14. Included within or immediately adjacent to pile strip 15 may be a barrier strip of the type disclosed in aforementioned U.S. Pat. No. 3,175,256, but this is entirely optional.

The portions of backing 10 on either side of pile strip 15 and between side edges 13 and 14 constitute flanges 16 and 17 that are devoid of pile material.

The weather strip is adapted to be inserted into a T-slot 18 formed in a window, door or other closure or in the frame or support therefor, this component being designated 19 and having an edge 20. T-slot 18 includes a longitudinally extending groove 21 having a groove width A and a longitudinally extending opening 22 having a width B that is less than width A of groove 21. Opening 22 communicates with groove 21 and, in fact, extends between groove 21 and edge 20.

The weather strip and T-slot are so constructed and proportioned relative to each other that when the weather strip is inserted into the T-slot, backing 10 is located in groove 21, and pile strip 15 protrudes through opening 22 and beyond edge 20. Since the width of backing 10 is greater than that of opening 22, the weather strip necesssrily is retained in the T-slot as a result of flanges 16 and 17 being located beneath flanges 23 and 24 of component 19.

Component 19 usually is fabricated of metal, particularly aluminum, but it may be of plastics or any other suitable material depending on the nature of the application.

The weather strip itself may be made of known materials. The pile strip 15 usually is made of filament polypropylene yarns that have been siliconed and ultraviolet stabilized, but other materials may be employed. The fibers of the pile should be resilient and durable, however. Backing 10 may be and preferably is of two part construction, the upper part 25 being a woven layer of, for example, polypropylene yarns, and the lower part 27 being a continuous layer of compatible plastics material, e.g., polypropylene extruded onto and laminated to the underside of woven layer 25.

Pile strip 15 may be woven into backing 10, and the extruded layer 27 of plastics material serves to assist in holding pile strip 15 in place.

Reference may be made to U.S. Pat. Nos. 4,288,482 and 4,288,483, both issued Sept. 8, 1981 and granted to Schlegel Corporation for other forms that the weather strip may take and for other materials from which it may be constructed. Broadly speaking, the materials of which the weather strip may be constructed are not critical. However, backing 10 should be relatively rigid so that it cannot be readily removed from the T-slot once inserted into groove 21 thereof.

A pile weather strip embodying the instant invention is capable of being installed in a T-slot in the normal way, i.e., by being slid longitudinally into the slot via an open end thereof. However, in accordance with the instant invention, the weather strip also is capable of being inserted into the T-slot by passage of backing 10 through opening 22 into groove 21. Normally the width of backing 10 relative to the width of opening 22 and the relatively rigid nature of backing 10 would not permit this to be achieved. However, in accordance with the instant invention, a line of weakness 26 is provided in backing 10 extending longitudinally of the backing and preferably at a location between pile strip 15 and one of the side edges, namely, in the embodiment shown, side edge 14. Thus, in this particular embodiment, the line of weakness 26 is provided in flange 17. Line of weakness 26 extends inwardly from bottom surface 12 toward front surface 11 but only part way through backing 10.

In the preferred embodiment of the invention line of weakness 26 is a score line or a so-called "kiss cut". Also in a preferred embodiment its depth is only 15% to 30% of the depth of backing 10 and, in the case where the backing is composed of an upper woven layer 25 and a continuous lower layer 27 of plastics material, in which case both layers normally are of about equal depth, the depth of line of weakness 26 is only about 30% to 60% of the depth of layer 27. In a preferred embodiment of the invention line of weakness 26 is located inwardly from edge 14 at a point 60% to 80% of the width of flange 17.

It also should be noted that it is preferable for a line of weakness 26 to be provided in each flange 16 and 17 so that the weather strip is not handed but can be installed by inserting either flange into the T-slot.

Figure 3:
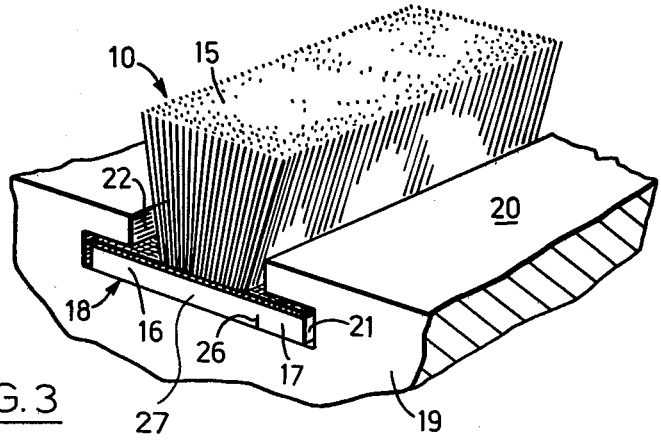
FIG. 3 shows the weather strip of FIG. 2 in position in the T-slot of FIG. 2.

To insert the pile weather strip into the T-slot, flange 16 first is inserted through opening 22 into the part of groove 21 below flange 23. The remaining part of the weather strip then may be inserted into the T-slot by pushing the weather strip towards the T-slot and running one's finger or a tool along the upper surface of flange 17 opposite line of weakness 26 causing a hinging action of flange 17 about the line of weakness 26. This effectively reduces the width of backing 10 so that it can pass through opening 22. Once this has been accomplished, flange 17 will, as a result of what has been termed a "living hinge action", spring into the part of groove 21 beneath flange 24. Since line of weakness 26, by virtue of abutment of its edges (see FIG. 3), resists any tendency for flange 17 to bend downwardly, the pile weather strip cannot be readily removed from the T-slot, although it can be removed forcefully when it is worn out or damaged.

While pile weather strip embodying the instant invention is particularly useful for retrofit, it also is useful in O.E.M. procedures where long lengths of weather strip have to be inserted in T-slots and frictional resistance may be met.

While reference has been made repeatedly herein to T-slots, it will be appreciated that the instant invention may be capable of being utilized with other types of grooves.

While preferred embodiments of the invention have been disclosed herein, those skilled in the art will appreciate that changes and modifications can be made therein without departing from the spirit and scope of the invention as defined in the appended claims.

We claim:

1. A pile weather strip comprising a backing having a front surface, a bottom surface opposite to said front surface and first and second side edges; a pile strip of resilient fibers upstanding from said front surface, secured to said backing and extending longitudinally of said backing at a location spaced inwardly from said first and second side edges, whereby said backing on either side of said pile strip and between said first and second side edges constitutes flanges devoid of pile material; said weather strip being adapted to be inserted into a T-slot comprising a longitudinally extending groove having a longitudinally extending opening of lesser width than the width of said groove communicating with said groove, when said weather strip is so inserted into said T-slot said backing being located in said groove and said pile strip protruding through said opening, the width of said backing between said side edges thereof being greater than the width of said opening, whereby said weather strip is retained in said groove, said weather strip being adapted to be inserted into said T-slot either by being slid longitudinally therein through one open end of said T-slot or by passage of said backing into said groove through said opening; the latter mode of insertion of said weather strip into said T-slot being accomplished by the provision in said backing of a line of weakness extending longitudinally of said backing and inwardly from said bottom surface through said front surface but only part way through said backing, the portion of said backing between said line of weakness and one of said edges thus being bendable in one direction about said line of weakness when said backing is inserted into said groove through said opening and then springing into said groove after passage of said portion of said backing through said opening, said line of weakness having abutable edges and resisting bending of said portion of said backing in a direction opposite to said one direction by abutment of said abutable edges when any attempt is made to remove said weather strip through said opening, so that said weather strip cannot be readily removed from said T-slot by being pulled through said opening.

2. A pile weather strip according to claim 1 wherein said line of weakness is at a location between said pile strip and said one edge of said backing and thus in one of said flanges.

3. A pile weather strip according to claim 1 or claim 2 wherein said line of weakness is a score line.

4. A pile weather strip according to claim 1 wherein there are two of said lines of weakness one in each of said flanges.

5. A pile weather strip according to claim 4 wherein said lines of weakness are score lines.

6. A pile weather strip according to claim 1 or claim 2 wherein said line of weakness is a score line and the depth of said score line is from 15% to 30% of the depth of said backing.

7. A method for inserting a pile weather strip into a T-slot, said strip and slot being of the types set forth in claim 1 which comprises inserting the portion of said backing between said line of weakness and the other of said edges of said backing through said opening into said groove, pushing said weather strip towards said T-slot while bending said portion of said backing between said line of weakness and said one edge of said backing in said one direction at said line of weakness to a sufficient extent to permit the remainder of said backing to pass through said opening into said groove, and permitting said portion of said backing between said line of weakness and said one edge of said backing to spring into said groove after said portion of said backing between said line of weakness and said one edge of said backing has passed through said opening.

8. A pile weather strip according to claim 2 wherein said line of weakness is located inwardly of said one edge of said backing at a point 60% to 80% of the width of said one flange.

9. A pile weather strip according to claim 8 wherein said line of weakness is a score line.

10. A pile weather strip according to claim 9 wherein the depth of said score line is from 15% to 30% of the depth of said backing.

11. A pile weather strip according to claim 9 wherein said backing comprises an upper layer of woven material and a lower continuous layer of plastics material laminated to said upper layer, said upper layer having said front surface and said lower layer having said bottom surface, said score line extending from said bottom surface only part way through said layer of plastics material.

12. A pile weather strip according to claim 11 wherein said score line is from 15% to 30% of the depth of said backing.

13. A method for inserting a pile weather strip into a T-slot, said strip and slot being of the types set forth in claim 2 which comprises inserting the other of said flanges through said opening into said groove, pushing said weather strip towards said T-slot while bending said portion of said backing upwardly at said line of weakness to a sufficient extent to permit the remainder of said backing to pass through said opening into said groove, and permitting said portion of said backing to spring into said groove after said portion of said backing has passed through said opening.

14. A pile weather strip according to claim 1 or claim 2 wherein said backing comprises an upper layer of woven material and a lower continuous layer of plastics material laminated to said upper layer, said upper layer having said front surface and said lower layer having said bottom surface, and wherein said line of weakness is a score line, said score line extending from said bottom surface only part way through said layer of plastics material.

15. A pile weather strip according to claim 1 or claim 2 wherein said backing comprises an upper layer of woven material and a lower continuous layer of plastics material laminated to said upper layer, said upper layer having said front surface and said lower layer having said bottom surface, and wherein said line of weakness is a score line, said score line extending from said bottom surface only part way through said layer of plastics material, and being from 15% to 30% of the depth of said backing.

16. In combination, a pile weather strip and a T-slot, said strip and slot being of the types set out in claims 1 or 2, said weahter strip being located in said T-slot with said backing in said groove and said pile extending through said opening.

* * * * *